US010463202B1

(12) United States Patent
Stowers

(10) Patent No.: US 10,463,202 B1
(45) Date of Patent: Nov. 5, 2019

(54) BATH LIQUID HEATER AND DISPENSER

(71) Applicant: Brandon Stowers, Hemet, CA (US)

(72) Inventor: Brandon Stowers, Hemet, CA (US)

( * ) Notice: Subject to any disclaimer, the term of this patent is extended or adjusted under 35 U.S.C. 154(b) by 0 days.

(21) Appl. No.: 16/114,976

(22) Filed: Aug. 28, 2018

(51) Int. Cl.
*A47K 5/12* (2006.01)
*B05B 11/00* (2006.01)

(52) U.S. Cl.
CPC ..... *A47K 5/1217* (2013.01); *B05B 11/0002* (2013.01); *A47K 5/1202* (2013.01)

(58) Field of Classification Search
CPC . A47K 5/1217; A47K 5/1202; B05B 11/0002
USPC ..... 222/52, 146.2, 146.5, 183.1, 181.1
See application file for complete search history.

(56) References Cited

U.S. PATENT DOCUMENTS 2,215,688 A 9/1940 Chamberlain
3,904,086 A 9/1975 Losenno
4,107,513 A 8/1978 Ashford
4,614,859 A * 9/1986 Beckering ..... F24H 1/185 219/214
D333,063 S 2/1993 Podesta Burke
6,431,400 B1 * 8/2002 O'Maley ..... B67D 7/344 141/367
6,454,127 B1 * 9/2002 Suomela ..... B05B 11/0002 222/146.5
D529,321 S * 10/2006 Gould ..... D6/545
8,056,764 B2 11/2011 Paasch
8,109,411 B2 2/2012 Yang
2008/0022480 A1 * 1/2008 Lee ..... B08B 3/00 15/320
2009/0095774 A1 * 4/2009 Domoy ..... A45D 34/04 222/146.5
2009/0101671 A1 * 4/2009 Cittadino ..... A47K 5/1202 222/23
2009/0140004 A1 * 6/2009 Scorgie ..... A47K 5/1217 222/52
2012/0168459 A1 * 7/2012 D'Onofrio ..... B05B 11/0002 222/52
2014/0259515 A1 * 9/2014 Nuttall ..... A47L 11/34 15/322

* cited by examiner

*Primary Examiner* — Lien M Ngo

(57) ABSTRACT

A bath liquid heater and dispenser for hands free liquid dispensing includes a housing having a top side with a concave depression and a central fill aperture extending through the depression and into a heating cavity. The concave depression is configured to receive a bottle of bath liquid. A pump is coupled within a bottom side of the housing from the heating cavity to a spout aperture. A heating tube extends from the fill aperture to the valve and a heating coil is wound around the heating tube. A CPU is coupled within the housing and is in operational communication with the pump and the heating coil. A control knob is coupled to the housing and controls the volume of bath liquid dispensed. A hand sensor is coupled to the housing and is in operational communication with the CPU to activate the pump and the heating coil.

5 Claims, 6 Drawing Sheets

BATH LIQUID HEATER AND DISPENSER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to liquid dispensers and more particularly pertains to a new liquid dispenser for hands free liquid dispensing.

BRIEF SUMMARY OF THE INVENTION

An embodiment of the disclosure meets the needs presented above by generally comprising a housing having a front side, a rear side, a left side, a right side, a bottom side, and a top side. The top side has a concave depression and a central fill aperture extending through the depression and into a heating cavity between the front side, the rear side, the left side, the right side, the bottom side, and the top side. The concave depression is configured to receive a bottle of bath liquid. The bottom side has a spout aperture extending through to the heating cavity, and the right side and the left side each have a right and a left battery cavity, respectively, extending towards the heating cavity. A pair of battery covers comprises a right battery and a left battery cover that are selectively engageable with the right and the left battery cavity, respectively. A pump is coupled within the bottom side of the housing from the heating cavity to the spout aperture. The pump has a valve adjacent the heating cavity and a spout extending through the spout aperture. A heating tube is coupled within the heating cavity and extends from the fill aperture to the valve. The heating tube is in fluid communication with the fill aperture and the valve. A heating coil is wound around the heating tube and is configured to heat a bath liquid passing through the heating tube. A CPU is coupled within the housing and is in operational communication with the pump and the heating coil. A control knob is coupled to the housing and is in operational communication with the valve to control the volume of bath liquid that passes through the pump. A hand sensor is coupled to the housing and is in operational communication with the CPU, the hand sensor activating the pump and the heating coil. A pair of batteries is coupled to the housing. The pair of batteries comprises a right battery and a left battery coupled within the right and the left battery cavity, respectively. Each of the pair of batteries is in operational communication with the CPU, the hand sensor, the pump, and the heating coil.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
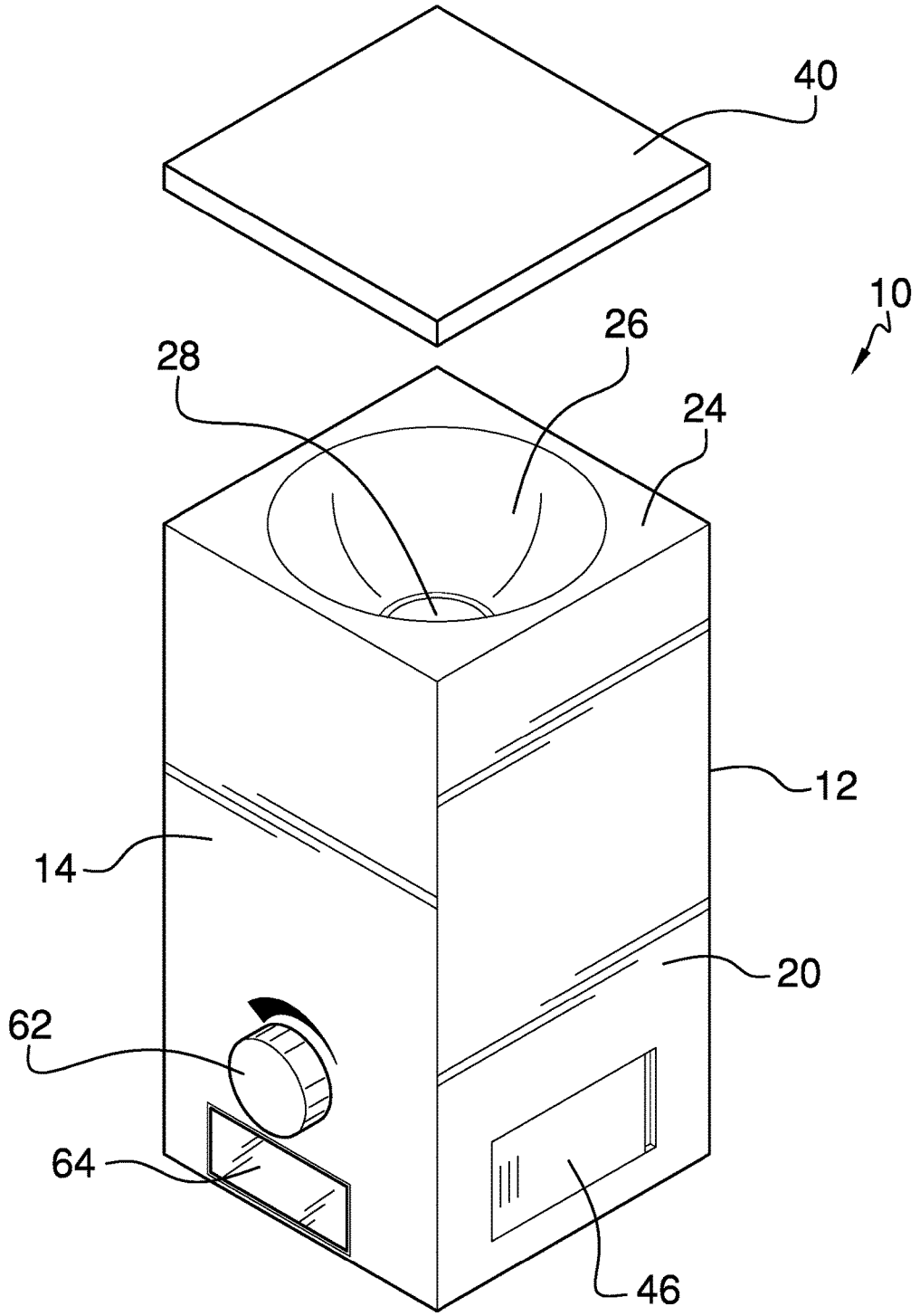
FIG. 1 is an isometric view of a bath liquid heater and dispenser according to an embodiment of the disclosure.
Figure 2:
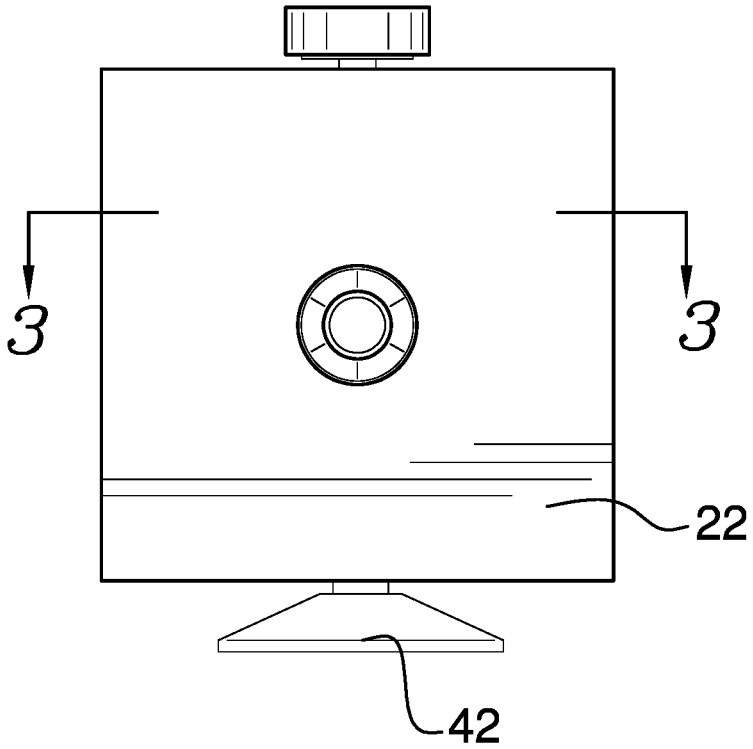
FIG. 2 is a bottom plan view of an embodiment of the disclosure.
Figure 3:
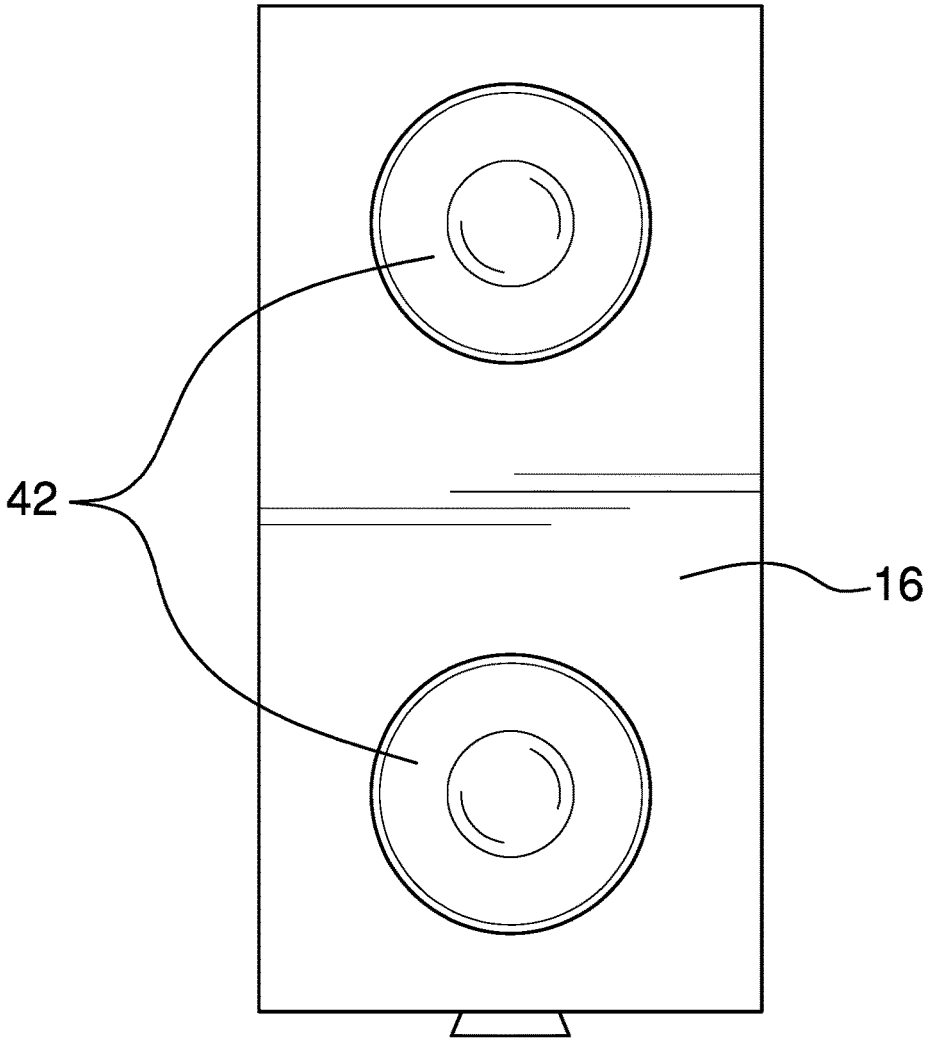
FIG. 3 is a rear elevation view of an embodiment of the disclosure.
Figure 4:
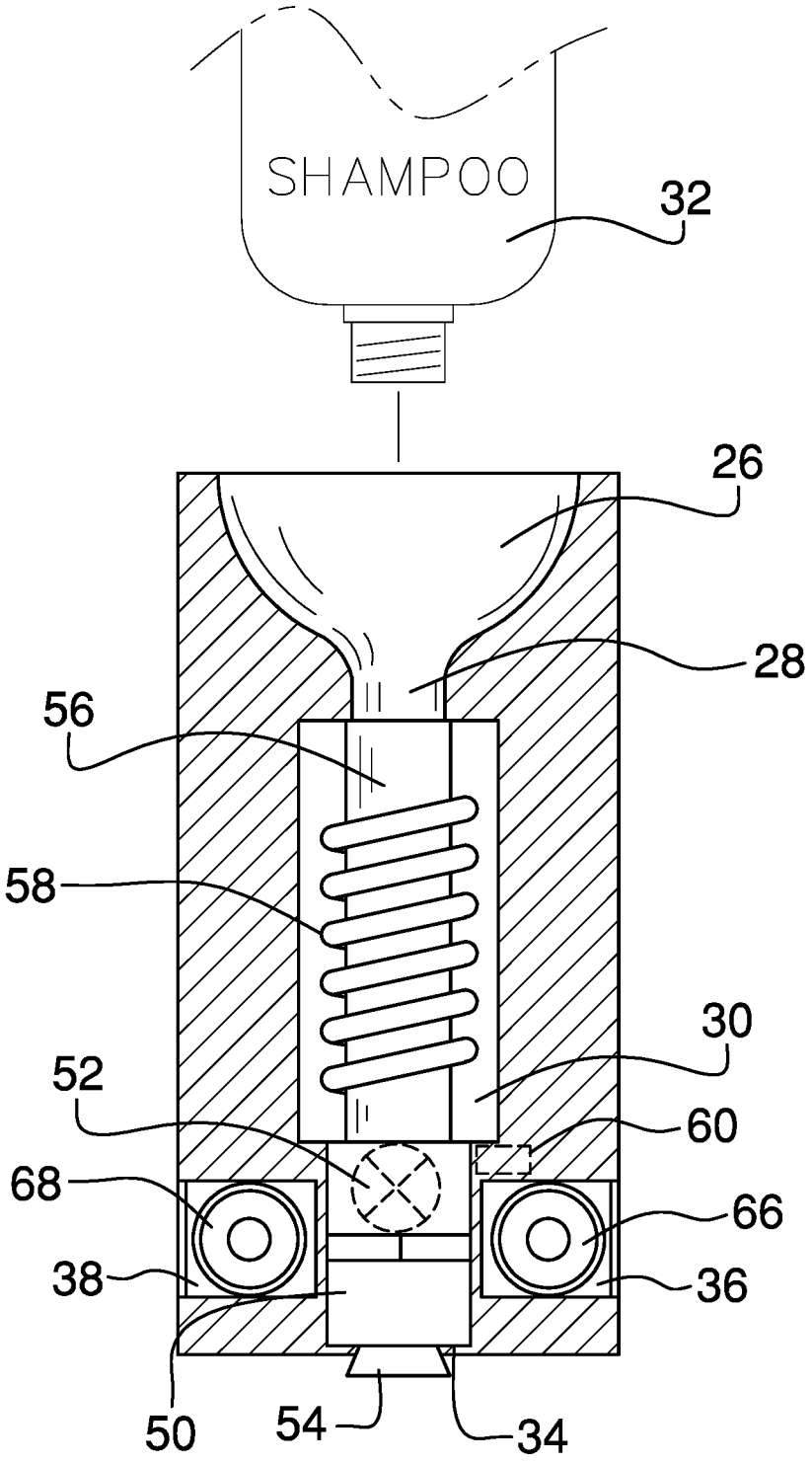
FIG. 4 is a cross-sectional view of an embodiment of the disclosure along line 4-4 of FIG. 2.
Figure 5:
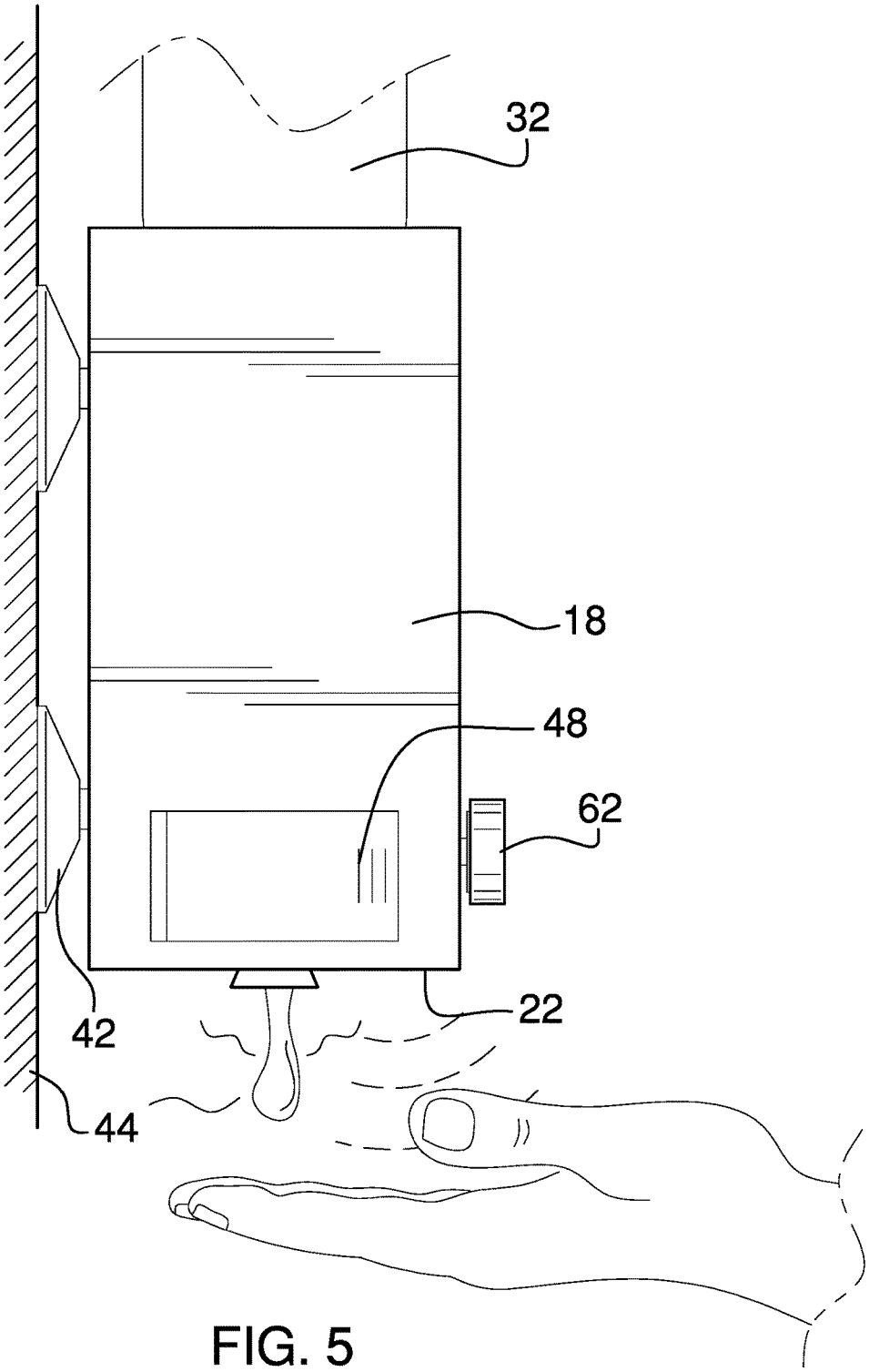
FIG. 5 is an in-use view of an embodiment of the disclosure.
Figure 6:
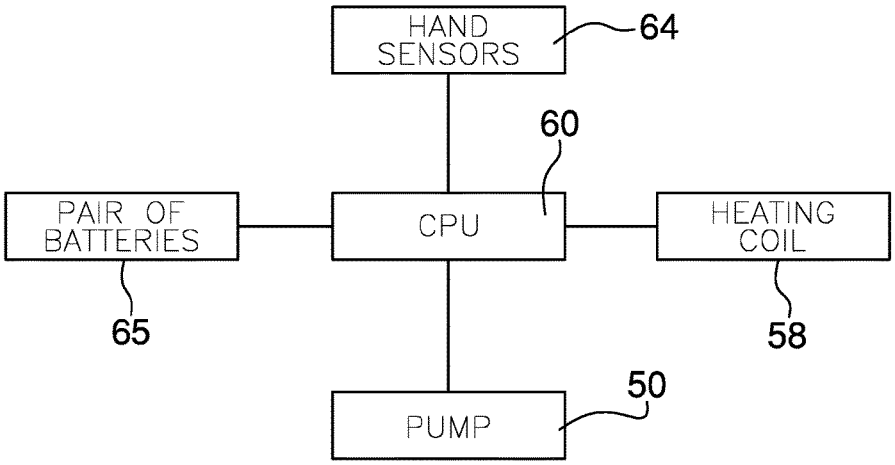
FIG. 6 is a block diagram of an embodiment of the disclosure.

With reference now to the drawings, and in particular to FIGS. 1 through 6 thereof, a new liquid dispenser embodying the principles and concepts of an embodiment of the disclosure and generally designated by the reference numeral 10 will be described.

As best illustrated in FIGS. 1 through 6, the bath liquid heater and dispenser 10 generally comprises a housing 12 having a front side 14, a rear side 16, a left side 18, a right side 20, a bottom side 22, and a top side 24. The top side 24 has a concave depression 26 and a central fill aperture 28 extending through the depression and into a heating cavity 30 between the front side 14, the rear side 16, the left side 18, the right side 20, the bottom side 22, and the top side 24. The concave depression 26 is configured to receive a bottle of bath liquid 32, such as shampoo, conditioner, or body wash. The bottom side 22 has a spout aperture 34 extending through to the heating cavity 30, and the right side 20 and the left side 18 each have a right battery cavity 36 and a left battery cavity 38, respectively, extending towards the heating cavity 30. The bottle of bath liquid 32 may remain inverted in the depression 26 or may be removed with the depression used as a reservoir for the bath liquid. If removed, a top lid 40 may be coupled to the top side 24 of the housing. The top lid 40 is selectively engageable with the top side 24 to cover and alternatively uncover the depression 26. A pair of suction cups 42 may be coupled to the rear side 16 of the housing to mount the housing to a wall 44. A pair of battery covers comprises a right battery cover 46 and a left battery cover 48 that are selectively engageable with the right battery cover 36 and the left battery cavity 38, respectively.

A pump 50 is coupled to the housing 12 within the bottom side 22 from the heating cavity 30 to the spout aperture 34. The pump 50 has a valve 52 adjacent the heating cavity 30 and a spout 54 extending through the spout aperture 34. A heating tube 56 is coupled within the heating cavity 30 and extends from the fill aperture 28 to the valve 52. The heating tube 26 is in fluid communication with the fill aperture 28 and the valve 26 to pass the bath liquid through to the pump 50. A heating coil 58 is wound around the heating tube 26 and is configured to heat the bath liquid passing through the heating tube 26. A CPU 60 is coupled within the housing 12 and is in operational communication with the pump 50 and the heating coil 58. A control knob 62 is coupled to the front side 14 of the housing and is in operational communication with the valve 52 to control the volume of bath liquid that passes through the pump 50. Each pump activation can thus release the desired amount of bath fluid to the user without waste. A hand sensor 64 is coupled to the front side 14 of the housing beneath the control knob 62 and proximal the bottom side. The hand sensor 64 is in operational communication with the CPU 60 and activates the pump 50 and the heating coil 58.

A pair of batteries 65 comprises a right battery 66 and a left battery 68 coupled within the right battery cavity 36 and the left battery cavity 38, respectively. Each of the pair of batteries 65 is in operational communication with, and provides power to, the CPU 60, the hand sensor 64, the pump 50, and the heating coil 58.

In use, the bottle of bath liquid 32 is inverted and placed in the depression 26. The bottle of bath liquid 32 is either left in place or removed with the depression 26 filled with bath liquid. When the hand sensor 64 detects a user's hand the pump 50 and the heating coil 58 are activated to heat and dispense the bath liquid through the spout 54. The control knob 62 may be manipulated to increase or decrease the amount of bath liquid dispensed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bath liquid heater and dispenser comprising:

a housing having a front side, a rear side, a left side, a right side, a bottom side, and a top side, the top side having a concave depression and a central fill aperture extending through the depression and into a heating cavity between the front side, the rear side, the left side, the right side, the bottom side, and the top side, the heating cavity being vertically elongated and oriented in vertical alignment under the central fill aperture, the concave depression being configured to receive a bottle of bath liquid, the bottom side having a spout aperture extending through to the heating cavity, the right side having a right battery cavity extending towards the heating cavity and the left side having a left battery cavity extending towards the heating cavity;

a pair of battery covers coupled to the housing, the pair of battery covers comprising a right battery cover and a left battery cover selectively engageable with the right and the left battery cavity, respectively;

a pump coupled to the housing, the pump being coupled within the bottom side from the heating cavity to the spout aperture, the pump having a valve adjacent the heating cavity and a spout extending through the spout aperture;

a heating tube coupled within the heating cavity, the heating tube extending vertically from the fill aperture to the valve, the heating tube being in fluid communication with the fill aperture and the valve;

a heating coil coupled to the heating tube above the valve, the heating coil being wound around the heating tube and being configured to heat a bath liquid passing through the heating tube before the bath liquid passes through the valve;

a CPU coupled within the housing, the CPU being in operational communication with the pump and the heating coil;

a control knob coupled to the housing, the control knob being in operational communication with the valve to control the volume of bath liquid that passes through the pump;

a hand sensor coupled to the housing, the hand sensor being in operational communication with the CPU, the hand sensor activating the pump and the heating coil; and a pair of batteries coupled to the housing, the pair of batteries comprising a right battery and a left battery coupled within the right and the left battery cavity, respectively, each of the pair of batteries being in operational communication with the CPU, the hand sensor, the pump, and the heating coil.

2. The bath liquid heater and dispenser of claim 1 further comprising a pair of suction cups coupled to the rear side of the housing, the pair of suction cups being configured to mount the housing to a wall.

3. The bath liquid heater and dispenser of claim 1 further comprising the control knob and the motion sensor being coupled to the front side of the housing, the motion sensor being proximal the bottom side and the control knob being above the motion sensor.

4. The bath liquid heater and dispenser of claim 1 further comprising a top lid coupled to the top side of the housing, the top lid being selectively engageable with the top side to cover and alternatively uncover the depression.

5. A bath liquid heater and dispenser comprising:

a housing having a front side, a rear side, a left side, a right side, a bottom side, and a top side, the top side having a concave depression and a central fill aperture extending through the depression and into a heating cavity between the front side, the rear side, the left side, the right side, the bottom side, and the top side, the concave depression being configured to receive a bottle of bath liquid, the heating cavity being vertically elongated and oriented in vertical alignment under the central fill aperture, the bottom side having a spout aperture extending through to the heating cavity, the right side having a right battery cavity extending towards the heating cavity and the left side having a left battery cavity extending towards the heating cavity;

a top lid coupled to the top side of the housing, the top lid being selectively engageable with the top side to cover and alternatively uncover the depression;

a pair of suction cups coupled to the rear side of the housing, the pair of suction cups being configured to mount the housing to a wall;

a pair of battery covers coupled to the housing, the pair of battery covers comprising a right battery cover and a left battery cover selectively engageable with the right and the left battery cavity, respectively;

a pump coupled to the housing, the pump being coupled within the bottom side from the heating cavity to the spout aperture, the pump having a valve adjacent the heating cavity and a spout extending through the spout aperture;

a heating tube coupled within the heating cavity, the heating tube extending vertically from the fill aperture to the valve, the heating tube being in fluid communication with the fill aperture and the valve;

a heating coil coupled to the heating tube above the valve, the heating coil being wound around the heating tube and being configured to heat a bath liquid passing through the heating tube before the bath liquid passes through the valve;

a CPU coupled within the housing, the CPU being in operational communication with the pump and the heating coil;

a control knob coupled to the housing, the control knob being coupled to the front side of the housing, the control knob being in operational communication with the valve to control the volume of bath liquid that passes through the pump;

a hand sensor coupled to the housing, the hand sensor being coupled to the front side of the housing beneath the control knob and proximal the bottom side, the hand sensor being in operational communication with the CPU, the hand sensor activating the pump and the heating coil; and a pair of batteries coupled to the housing, the pair of batteries comprising a right battery and a left battery coupled within the right and the left battery cavity, respectively, each of the pair of batteries being in operational communication with the CPU, the hand sensor, the pump, and the heating coil.

* * * * *